US007788927B2

(12) United States Patent
McMasters et al.

(10) Patent No.: US 7,788,927 B2
(45) Date of Patent: Sep. 7, 2010

(54) TURBINE ENGINE FUEL NOZZLES AND METHODS OF ASSEMBLING THE SAME

(75) Inventors: Marie Ann McMasters, Mason, OH (US); Christopher Charles Glynn, Hamilton, OH (US); Brian C. Brougher, Hamilton, OH (US)

(73) Assignee: General Electric Company, Schenectady ( * ) Notice: Subject to any disclaimer, the term of this patent is extended or adjusted under 35 U.S.C. 154(b) by 695 days.

(21) Appl. No.: 11/290,116

(22) Filed: Nov. 30, 2005

(65) Prior Publication Data

US 2007/0119177 A1 May 31, 2007

(51) Int. Cl.
*F02C 1/00* (2006.01)
*F02G 3/00* (2006.01)

(52) U.S. Cl. ..... 60/739

(58) Field of Classification Search ..... 60/740, 60/743, 734, 748, 742, 747, 737, 776, 258, 60/739

See application file for complete search history.

(56) References Cited

U.S. PATENT DOCUMENTS 3,899,884 A 8/1975 Ekstedt
4,198,815 A * 4/1980 Bobo et al. ..... 60/737
4,854,127 A * 8/1989 Vinson et al. ..... 60/742
5,596,873 A 1/1997 Joshi et al.
5,613,363 A 3/1997 Joshi et al.
6,286,302 B1 9/2001 Farmer et al.
6,327,860 B1 12/2001 Critchley
6,481,209 B1 11/2002 Johnson et al.
6,497,103 B2 12/2002 Johnson et al.
6,718,770 B2 * 4/2004 Laing et al. ..... 60/740
6,932,093 B2 8/2005 Ogden et al.
7,013,649 B2 3/2006 Monty

* cited by examiner

*Primary Examiner*—Michael Cuff
*Assistant Examiner*—Andrew Nguyen
(74) *Attorney, Agent, or Firm*—V G Ramaswamy; William Scott Andes; General Electric Company

(57) ABSTRACT

A method for assembling a fuel nozzle for a turbine engine is provided. The method includes coupling a one-piece housing to a one-piece venturi wherein the housing defines an annular fuel nozzle tip and the venturi defines a fuel chamber within the fuel nozzle tip. The method further includes coupling a one-piece swirler to the venturi such that the swirler extends radially inward from the venturi.

17 Claims, 3 Drawing Sheets

TURBINE ENGINE FUEL NOZZLES AND METHODS OF ASSEMBLING THE SAME

BACKGROUND OF THE INVENTION

This invention relates generally to turbine engines and, more particularly to fuel nozzles and methods of assembling the same.

Turbine engines typically include a plurality of fuel nozzles for supplying fuel to the engine. Improving the life cycle of fuel nozzles installed within the turbine engine may extend the longevity of the turbine engine. Known fuel nozzles include a delivery system and a support system. Known fuel nozzles are generally expensive to fabricate and/or repair because known fuel nozzle designs include a complex assembly of more than thirty components. The delivery system delivers fuel to the turbine engine and is supported, and is shielded within the turbine engine, by the support system. More specifically, known support systems surround the delivery system, and as such are subjected to higher temperatures and have higher operating temperatures than delivery systems which are cooled by fluid flowing through the fuel nozzle.

Over time, continued exposure to high temperatures during turbine engine operations may induce thermal stresses to the fuel nozzles which may damage the fuel nozzle and/or adversely effect the operation of the fuel nozzle. For example, thermal stresses may cause fuel flow reductions and/or lead to excessive fuel maldistribution within the turbine engine. Furthermore, over time, continued operation with damaged fuel nozzles may result in decreased turbine efficiency, turbine component distress, and/or reduced engine exhaust gas temperature margin.

BRIEF DESCRIPTION OF THE INVENTION

In one aspect, a method for assembling a fuel nozzle for a turbine engine is provided. The method includes coupling a one-piece housing to a one piece venturi. The housing includes an annular fuel nozzle tip and the venturi defines a fuel chamber within the fuel nozzle tip. The method further includes coupling a one-piece swirler to the venturi such that the swirler extends radially inward from the venturi.

In another aspect, a fuel nozzle for a turbine engine is provided. The fuel nozzle includes a one-piece housing coupled to a one-piece venturi. The housing includes an annular fuel nozzle tip and a plurality of openings configured to discharge air radially outward from the fuel nozzle tip. The venturi is coupled to the housing and defines a fuel chamber within the fuel nozzle tip. A one-piece swirler is coupled to and extends radially inward from the venturi. The swirler facilitates enhancing mixing of the fuel and air within the fuel chamber.

In a further aspect, a turbine engine is provided. The turbine engine includes a combustor having a casing and a fuel nozzle configured to discharge fuel into the combustor. The fuel nozzle includes a one-piece housing coupled to a one-piece venturi. The housing includes an annular fuel nozzle tip and a plurality of openings configured to discharge air radially outward from the fuel nozzle tip. The venturi is coupled to the housing and defines a fuel chamber within the fuel nozzle tip. A one-piece swirler is coupled to and extends radially inward from the venturi. The swirler facilitates enhancing mixing of the fuel and air within the combustor.

DETAILED DESCRIPTION OF THE INVENTION

Figure 1:
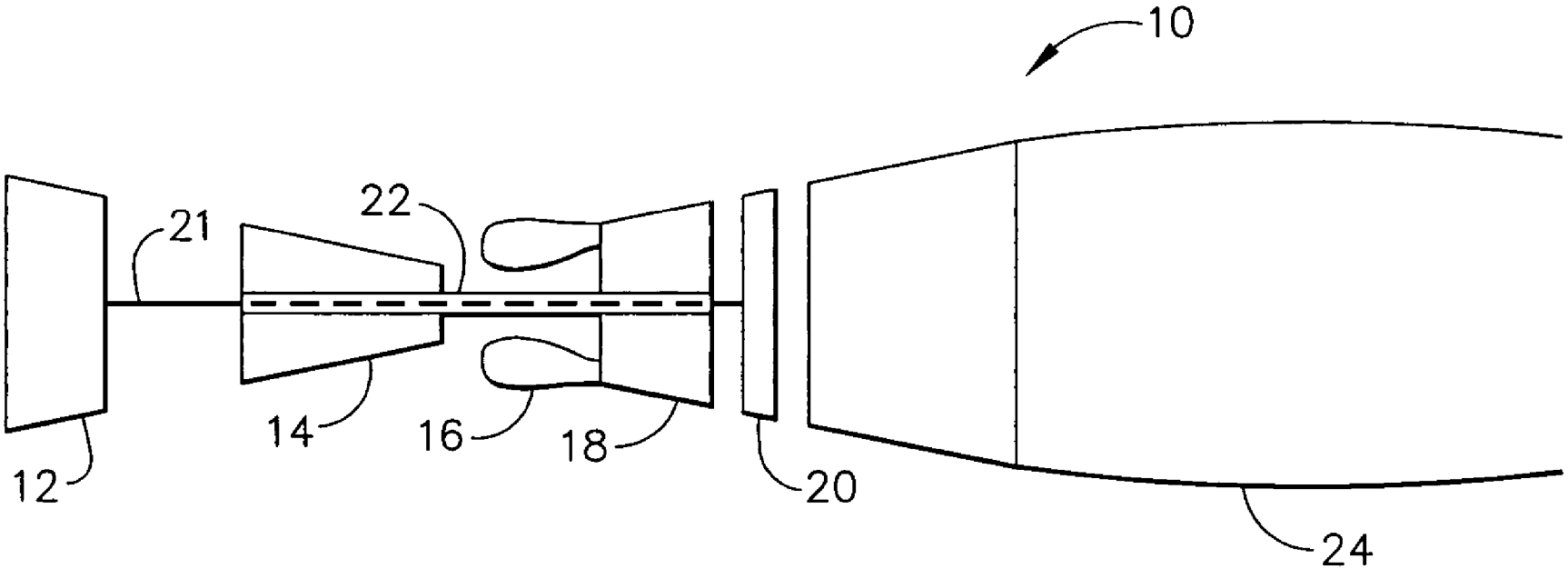
FIG. 1 is a schematic illustration of an exemplary gas turbine engine.

FIG. 1 is a schematic illustration of an exemplary gas turbine engine 10 including a low pressure compressor 12, a high pressure compressor 14, and a combustor 16. Engine 10 also includes a high pressure turbine 18 and a low pressure turbine 20. Compressor 12 and turbine 20 are coupled by a first shaft 22, and compressor 14 and turbine 18 are coupled by a second shaft 21. In one embodiment, gas turbine engine 10 is an LM2500 engine commercially available from General Electric Aircraft Engines, Cincinnati, Ohio. In another embodiment, gas turbine engine 10 is a CFM engine commercially available from General Electric Aircraft Engines, Cincinnati, Ohio.

In operation, air flows through low pressure compressor 12 supplying compressed air from low pressure compressor 12 to high pressure compressor 14. The highly compressed air is delivered to combustor 16. Airflow from combustor 16 is channeled through a turbine nozzle to drive turbines 18 and 20, prior to exiting gas turbine engine 10 through an exhaust nozzle 24. As is known in the art, gas turbine engines further include fuel nozzles (not shown) which supply fuel to the combustor 16.

Figure 2:
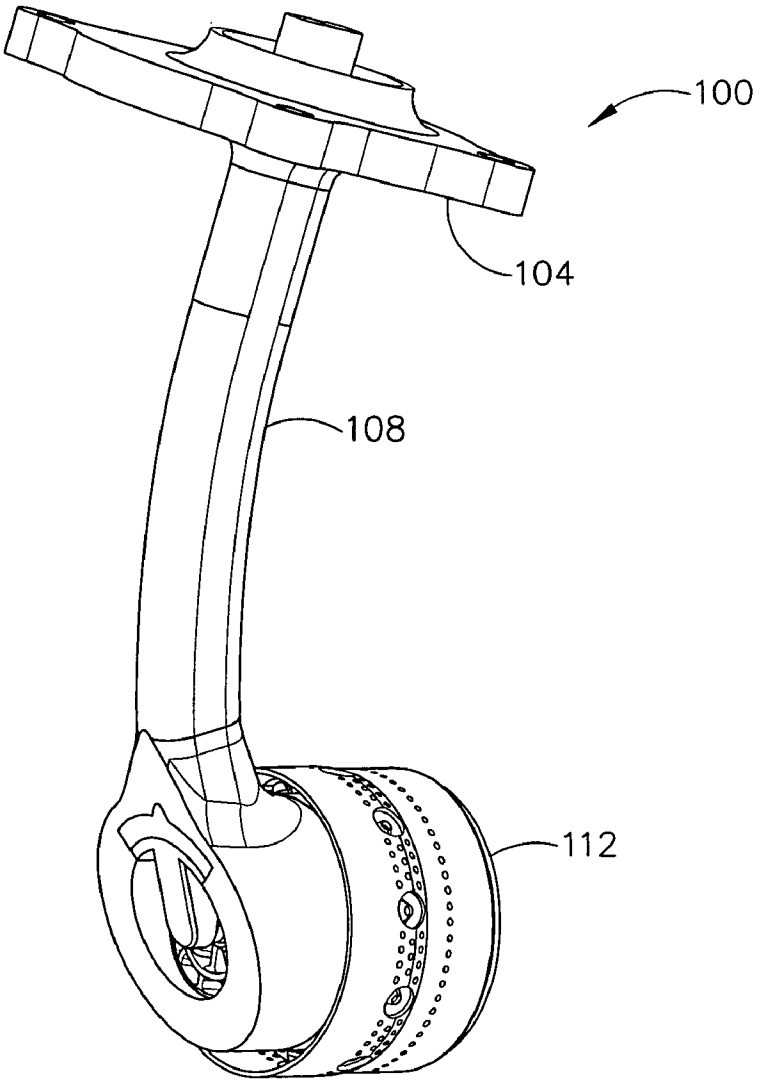
FIG. 2 is a perspective view of an exemplary fuel nozzle that may be used with the turbine engine shown in FIG. 1.

FIG. 2 is a perspective view of an exemplary fuel nozzle 100. In the exemplary embodiment, fuel nozzle 100 includes a mounting flange 104, a stem 108, and an annular fuel nozzle tip 112.

Figure 3:
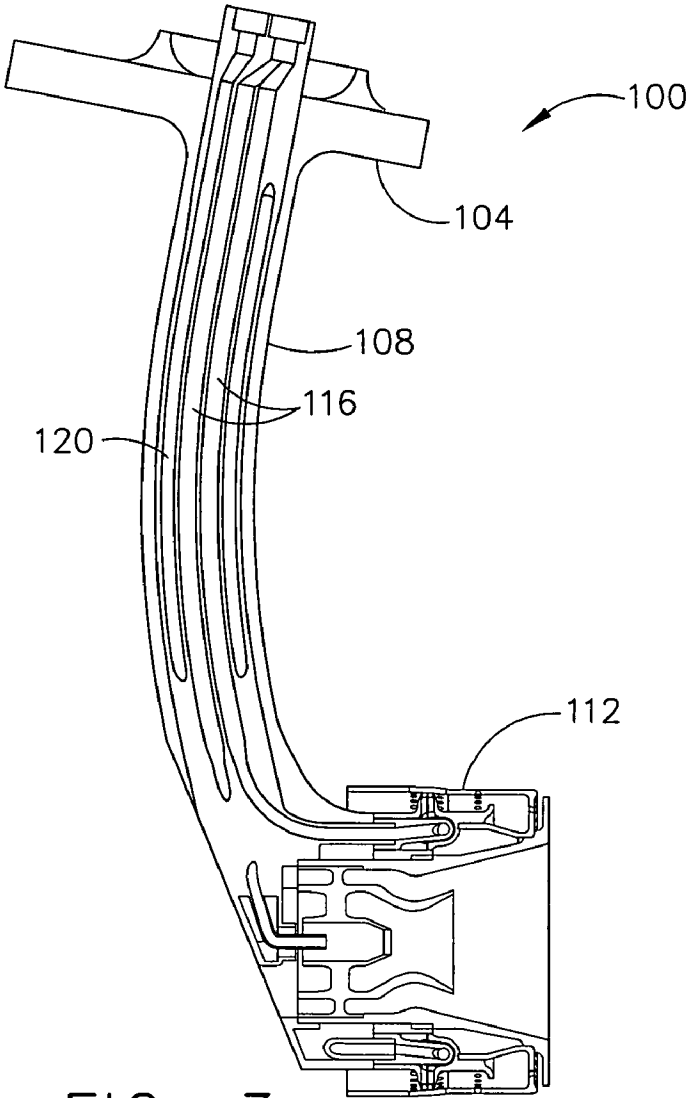
FIG. 3 is a partial cross-sectional view of the fuel nozzle shown in FIG. 2.

FIG. 3 is a partial cross-sectional view of the fuel nozzle shown in FIG. 2. In the exemplary embodiment stem 108 is includes a main fuel passageway 116 and a pilot fuel passageway 120 extending therethrough. More specifically, main fuel passageway 116 and pilot fuel passageway 120 extend generally axially through stem 108.

Figure 4:
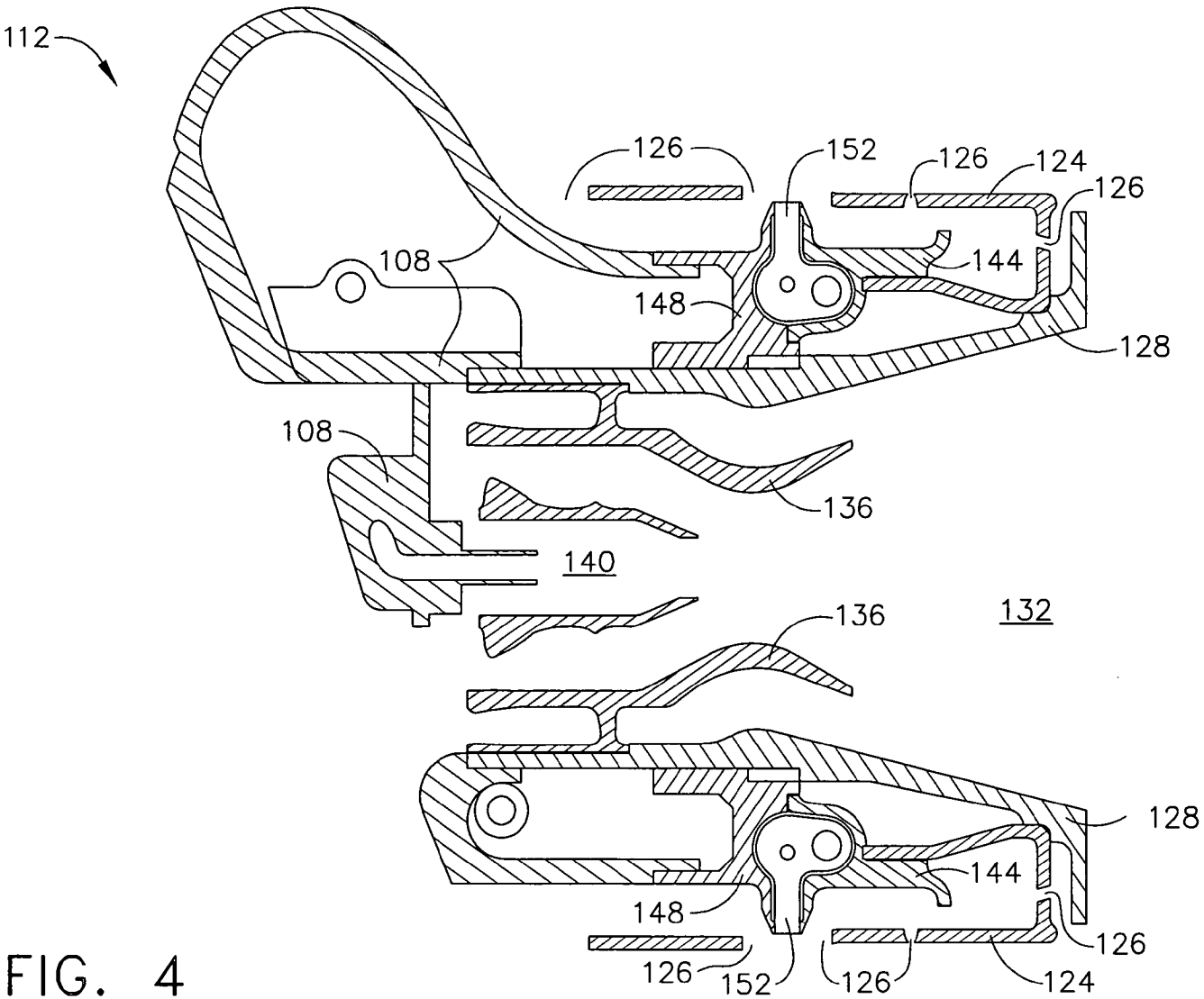
FIG. 4 is a cross-sectional view of a fuel nozzle tip used with the fuel nozzle shown in FIGS. 2 and 3.

FIG. 4 is a cross-sectional view of a fuel nozzle tip used with the fuel nozzle shown in FIGS. 2 and 3. In the exemplary embodiment, fuel nozzle tip 112 is defined annularly by a housing 124. Housing 124 is fabricated unitarily from one piece, and attaches to a venturi 128 via a slip joint. Housing 124 also includes a plurality of openings 126. Venturi 128 is fabricated unitarily from one piece, and defines a fuel chamber 132 within fuel nozzle tip 112. A swirler 136, fabricated unitarily from one-piece, is positioned radially inward from fuel chamber 132 and is coupled to venturi 128. An injector 140 is coupled to stem 108 and is positioned radially inward from swirler 136.

Fuel nozzle tip 112 also includes an aft heat shield 144 and a forward heat shield 148. Aft heat shield 144 is coupled to housing 124 and venturi 128. Forward heat shield 148 is coupled to venturi 128 and stem 108. The coupling between forward heat shield 148 and stem 108 provides additional support for fuel nozzle tip 112. Aft heat shield 144 and forward heat shield 148 are also coupled together to define a cavity therebetween that partially encloses a main fuel circuit 152. Main fuel circuit 152 is coupled to forward heat shield 148 within the cavity.

Mounting flange 104 facilitates coupling fuel nozzle 100 to the casing (not shown) of a turbine engine combustor, such as combustor 16 (shown in FIG. 1). Mounting flange 104 is coupled to stem 108 such that stem 108 extends at least partially through a center of mounting flange 104. Stem 108 extends to fuel nozzle tip 112.

In the exemplary embodiment, fuel nozzle tip 112 extends from stem 108 such that main fuel passageway 116 and pilot fuel passageway 120 are coupled in flow communication with fuel nozzle tip 112. Specifically, main fuel passageway 116 is coupled in flow communication to main fuel circuit 152 defined within fuel nozzle tip 112. Likewise, pilot fuel passageway 120 is coupled in flow communication with injector 140 that is positioned radially inward from swirler 136 and within fuel nozzle tip 112.

During operation of the turbine engine, initially, pilot fuel is supplied through pilot fuel passageway 120 during predetermined engine operation conditions, such as during startup and idle operations. The pilot fuel is discharged from injector 140 through swirler 136. Swirler 136 enhances the mixing of air and fuel within fuel chamber 132.

When additional power is demanded, primary fuel is supplied through main fuel passageway 116 and is circulated through main fuel circuit 152. Primary fuel circulating through main fuel circuit 152, is substantially insulated by aft heat shield 144 and forward heat shield 148. The insulation barrier facilitates shielding the primary fuel channeled through main fuel circuit 152 from the other components of fuel nozzle tip 112, which may have become heated during operation of the engine. Separating the primary fuel from the heated fuel nozzle tip 112 facilitates preventing fuel coking within fuel nozzle 100. While circulating through main fuel circuit 152, the primary fuel is released into fuel chamber 132.

The release of primary fuel into fuel chamber 132 creates a desired flame within a combustion chamber of the combustor to power the turbine engine. This process in-turn creates heat throughout fuel nozzle 100. To facilitate cooling fuel nozzle tip 112, openings 126 in housing 124 allow air to discharge radially outward through fuel nozzle tip 112.

The above-described fuel nozzle for a turbine engine comprises fewer components and joints than known fuel nozzles. Specifically, the above described fuel nozzle requires fewer components because of the use of a one-piece housing, a one-piece venturi, and a one-piece swirler. As a result, the described fuel nozzle provides a lighter, less costly alternative to known fuel nozzles. Moreover, the described fuel nozzle provides fewer opportunities for failure and is more easily repairable compared to known fuel nozzles.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the methods and systems described herein are described in the context of supplying fuel to a turbine engine, it is understood that the fuel nozzle methods and systems described herein are not limited to turbine engines. Likewise, the fuel nozzle components illustrated are not limited to the specific embodiments described herein, but rather, components of the fuel nozzle can be utilized independently and separately from other components described herein.

While the invention has been described in terms of various specific embodiments, those skilled in the art will recognize that the invention can be practiced with modification within the spirit and scope of the claims.

What is claimed is:

1. A method for assembling a fuel nozzle for a turbine engine, said method comprising:

coupling a one-piece housing to a one-piece venturi wherein the housing defines an annular fuel nozzle tip, said housing comprising a plurality of openings configured to discharge air radially outward, and the venturi defines a fuel chamber within the fuel nozzle tip;

coupling a one-piece swirler to the venturi such that the swirler extends radially inward from the venturi;

coupling an aft heat shield to the housing;

coupling a forward heat shield located substantially axially forward from the aft heat shield directly to the outer surface of the venturi; and coupling the aft heat shield directly to the forward heat shield to define a cavity such that a main fuel circuit extends at least partially through the cavity.

2. A method in accordance with claim 1 further comprising coupling the main fuel circuit to the forward heat shield.

3. A method in accordance with claim 1 further comprising coupling a stem to the venturi and the forward heat shield to facilitate supporting the fuel nozzle tip wherein the stem includes a pilot fuel passageway and a main fuel passageway.

4. A method in accordance with claim 3 further comprising coupling the main fuel passageway in flow communication with the main fuel circuit to facilitate discharging fuel into the fuel chamber.

5. A method in accordance with claim 1 further comprising securing the fuel nozzle within the turbine engine.

6. A method in accordance with claim 3 further comprising coupling an injector to the stem such that the injector is positioned radially inward from the swirler.

7. A method in accordance with claim 6 further comprising coupling the injector in flow communication with the pilot fuel passageway to facilitate discharging pilot fuel into the fuel chamber.

8. A fuel nozzle for a turbine engine, said fuel nozzle comprising:

a one-piece housing comprising an annular fuel nozzle tip, said housing further comprising a plurality of openings configured to discharge air radially outward from said fuel nozzle tip;

an annular one-piece venturi defining a fuel chamber within said fuel nozzle tip, said venturi coupled to said housing via a slip joint;

a one-piece swirler coupled to and extending radially inward from said venturi, said swirler facilitates enhancing mixing of air and fuel within said fuel chamber;

an aft heat shield directly coupled to a forward heat shield, said aft heat shield coupled to said housing, said forward heat shield directly coupled to an outer surface of said venturi; and a main fuel circuit extending at least partially through a cavity defined between said aft and forward heat shields.

9. A fuel nozzle in accordance with claim 8 further comprising a stem coupled to said venturi and said forward heat shield, said stem supports said fuel nozzle tip and comprises a pilot fuel passageway and a main fuel passageway for channeling fuel into said fuel chamber.

10. A fuel nozzle in accordance with claim 9 wherein said stem facilitates securing said fuel nozzle within the turbine engine.

11. A fuel nozzle in accordance with claim 9 further comprising a fuel injector radially inward from said swirler, said fuel injector coupled to said stem.

12. A fuel nozzle in accordance with claim 11 wherein said fuel injector is coupled in flow communication with said pilot fuel passageway for discharging fuel into said fuel chamber.

13. A turbine engine comprising:

a combustor comprising a casing; and a fuel nozzle configured to discharge fuel into said combustor, said fuel nozzle comprising:

a one-piece housing comprising an annular fuel nozzle tip and a plurality of openings for discharging air radially outward from said fuel nozzle tip;

a one-piece venturi defining an annular fuel chamber within said fuel nozzle tip, said venturi coupled to said housing via a slip joint;

a one-piece swirler positioned within said fuel chamber and extending radially inward from said venturi, wherein said swirler facilitates enhancing mixing of fuel and air within said combustor;

a one-piece aft heat shield directly coupled to a one-piece forward heat shield, said aft heat shield coupled to said housing, said forward heat shield directly coupled to an outer surface of said venturi; and a main fuel circuit extending at least partially through a cavity defined between said aft and forward heat shields.

14. A turbine engine in accordance with claim 13 wherein said fuel nozzle further comprises a stem coupled to said venturi, said stem configured to support said fuel nozzle tip, said stem comprising a pilot fuel passageway and a main fuel passageway, each of said pilot fuel passageway and said main fuel passageway are configured to discharge fuel into said combustor.

15. A turbine engine in accordance with claim 14 wherein said stem is configured to couple said fuel nozzle to said combustor casing.

16. A turbine engine in accordance with claim 13 further comprising a fuel injector coupled radially inward from said swirler for injecting fuel into said fuel chamber.

17. A turbine engine in accordance with claim 16 wherein said injector is coupled to said stem.

* * * * *